US010022000B2

(12) United States Patent
Walvius et al.

(10) Patent No.: US 10,022,000 B2
(45) **Date of Patent: *Jul. 17, 2018**

(54) FABRIC SYSTEM

(71) Applicant: SHEEX, Inc., Irmo, SC (US)

(72) Inventors: Susan Walvius, Irmo, SC (US); Michelle Marciniak, Irmo, SC (US)

(73) Assignee: SHEEX, Inc., Marlton, NJ (US)

( * ) Notice: Subject to any disclaimer, the term of this patent is extended or adjusted under 35 U.S.C. 154(b) by 336 days.

This patent is subject to a terminal disclaimer.

(21) Appl. No.: 14/801,355

(22) Filed: Jul. 16, 2015

(65) Prior Publication Data

US 2016/0022061 A1 Jan. 28, 2016

Related U.S. Application Data

(63) Continuation of application No. 13/272,977, filed on Oct. 31, 2011, now Pat. No. 9,109,309, which is a (Continued)

(51) Int. Cl.
*A47G 9/02* (2006.01)
*D04B 1/18* (2006.01)

(Continued)

(52) U.S. Cl.
CPC ..... *A47G 9/0238* (2013.01); *A47G 9/02* (2013.01); *A47G 9/0246* (2013.01); *D04B 1/14* (2013.01);

(Continued)

(58) Field of Classification Search
CPC ..... A47G 9/0238; A47G 9/0246; A47G 9/00; A47G 9/02; D04B 1/14; D04B 1/18;

(Continued)

(56) References Cited

U.S. PATENT DOCUMENTS 2,804,632 A 9/1957 Ford
4,648,186 A 3/1987 Dolman et al.

(Continued)

FOREIGN PATENT DOCUMENTS

AU 2009296195 2/2014
AU 2012202375 2/2014

(Continued)

OTHER PUBLICATIONS

Chinese Office Action with English translation issued in Chinese Application No. 201510089171.0 dated May 23, 2016 (26 pages).

(Continued)

*Primary Examiner* — Nicholas F Polito
(74) *Attorney, Agent, or Firm* — David M. Morse, Esq

(57) ABSTRACT

Bedding material including a first fabric section manufactured from performance fabric and having a first and second side; and, a second fabric section attached to the first side of the first fabric section. Additionally, a third fabric section can be attached to the second side of the first fabric section. The first fabric section can be attached to the second fabric section through a flatlock stitch. The first fabric section can include a first zone and a second zone wherein the first zone contains different performance properties from the second zone and the first zone can have thermal or moisture wicking properties.

21 Claims, 4 Drawing Sheets

Related U.S. Application Data continuation of application No. 12/569,659, filed on Sep. 29, 2009, now Pat. No. 8,566,982.

(60) Provisional application No. 61/101,049, filed on Sep. 29, 2008.

(51) Int. Cl.

| | |
|---|---|
| ***D04B 1/14*** | (2006.01) |
| ***D04B 9/42*** | (2006.01) |
| ***D05B 1/04*** | (2006.01) |
| ***D06C 7/02*** | (2006.01) |

(52) U.S. Cl.

CPC ..... *D04B 1/18* (2013.01); *D04B 9/42* (2013.01); *D05B 1/04* (2013.01); *D06C 7/02* (2013.01); *D10B 2503/062* (2013.01)

(58) Field of Classification Search

CPC ... D04B 9/42; D05B 1/04; D06C 7/02; D10B 2503/062

See application file for complete search history.

(56) References Cited

U.S. PATENT DOCUMENTS

| | | | |
|---|---|---|---|
| 4,690,859 | A | 9/1987 | Porter et al. |
| 5,092,088 | A | 3/1992 | Way |
| 5,636,380 | A | 6/1997 | Schindler et al. |
| 5,765,241 | A | 6/1998 | MacDonald |
| 5,817,391 | A | 10/1998 | Rock et al. |
| 6,381,779 | B1 | 5/2002 | Thompson |
| 6,823,548 | B2 | 11/2004 | Murphy et al. |
| 6,883,193 | B2 | 4/2005 | Brooks et al. |
| 7,117,695 | B2 | 10/2006 | Laycock et al. |
| 7,176,419 | B2 | 2/2007 | Ellis et al. |
| 7,240,383 | B2 | 7/2007 | Stewart |
| 7,428,772 | B2 | 9/2008 | Rock |
| 8,171,581 | B2 | 5/2012 | Agarwall |
| 8,402,580 | B2 | 3/2013 | Walvius et al. |
| 8,566,982 | B2 | 10/2013 | Walvius et al. |
| 2004/0172754 | A1 | 9/2004 | Brooks et al. |
| 2005/0132754 | A1 | 6/2005 | Taniguchi et al. |
| 2005/0273930 | A1 | 12/2005 | Phillipps |
| 2005/0284189 | A1 | 12/2005 | Steward |
| 2007/0061967 | A1 | 5/2007 | Fox |
| 2007/0157383 | A1 | 7/2007 | Burns |
| 2007/0266495 | A1 | 11/2007 | Stribling |
| 2007/0283493 | A1 | 12/2007 | Link et al. |
| 2008/0028523 | A1 | 2/2008 | Robertson et al. |
| 2011/0000020 | A1 | 1/2011 | Walvius et al. |
| 2012/0024013 | A1 | 2/2012 | Walvius et al. |
| 2012/0030874 | A1 | 2/2012 | Walvius et al. |

FOREIGN PATENT DOCUMENTS

| | | | |
|---|---|---|---|
| CA | 2738658 | | 9/2013 |
| CN | 1308150 | | 8/2001 |
| CN | 2456671 | | 10/2001 |
| CN | 2841696 | | 11/2006 |
| CN | 101155847 | | 4/2008 |
| CN | 102245822 | A | 11/2011 |
| CN | 102551442 | A | 7/2012 |
| EP | 2344691 | | 7/2011 |
| EP | 2601866 | | 6/2013 |
| ES | 2368481 | | 11/2011 |
| HK | 1154058 | A | 4/2012 |
| HK | 1173055 | A | 5/2013 |
| JP | 8-256891 | | 10/1996 |
| JP | 8256891 | | 10/1996 |
| JP | 11-309183 | | 11/1999 |
| JP | 11309183 | | 11/1999 |
| WO | WO 2006/086715 | | 8/2006 |
| WO | WO2010/037082 | | 4/2010 |
| WO | WO 2014/150901 | | 9/2014 |

OTHER PUBLICATIONS

International Search Report and Written Opinion issued by the Korean Intellectual Property Office for related PCT Patent Application No. PCT/US2009/058716 dated Apr. 29, 2010.

International Preliminary Report on Patentability issued by the Korean Intellectual Property Office for related PCT Patent Application No. PCT/US2009/058716 dated Apr. 7, 2011 (6 pages).

Voluntary Amendment from corresponding Australian patent application No. 2009296195, filed Apr. 12, 2011 (11 pages).

Canadian office action dated Jan. 16, 2012 in Canadian application No. 2,738,658 (4 pages).

European communication dated May 27, 2011 from European application No. 09817024.4 (2 pages).

Response to European communication dated May 27, 2011 from European application No. 09817024.4 filed Nov. 22, 2011 (12 pages).

International Preliminary Report on Patentability from PCT application No. PCT/US2009/058716 dated Apr. 7, 2011 (6 pages).

International Search Report from PCT application No. PCT/US2009/058716 dated Apr. 29, 2010 (3 pages).

Written Opinion from PCT application no. PCT/US2009/058716 dated Apr. 29, 2010 (4 pages).

European Communication dated Feb. 16, 2012 from European application No. 09817024.4 (3 pages).

European Communication dated Mar. 12, 2012 from European application No. 09817024.4 (5 pages).

Response to Office Action dated Jan. 16, 2012 from Canadian Application No. 2738658, filed Apr. 16, 2012 (25 pages).

Voluntary Amendment filed in Australian Application No. 2009296195 filed Apr. 24, 2012 (12 pages).

Publication Notice of Hong Kong Application No. 11108432.6 dated Apr. 25, 2012 (1 page).

European Communication dated May 9, 2012 from European application No. 09817024.4 (4 pages).

Response to European Communication dated Mar. 12, 2012 from European application No. 09817024.4, filed Apr. 25, 2012 (12 pages).

Canadian office action dated May 30, 2012 in Canadian application No. 2,738,658 (11 pages).

Office Action from Australian Patent Application No. 2012202375 dated Nov. 20, 2012 (5 pages).

Response to Office Action dated May 30, 2012 in Canadian Application No. 2,738,658 filed Aug. 30, 2012 (21 pages).

Voluntary Amendment filed in Chinese Application No. 2011-10443469.9 on Nov. 29, 2012 (1 page).

Response to Communication dated May 9, 2012 in European Application No. 09817024.4 filed on Sep. 7, 2012 (9 pages).

European Communication dated Nov. 22, 2012 from European application No. 09817024.4 (24 pages).

Chinese Office Action with English translation for Chinese Application No. 200980147643.6 dated Nov. 23, 2012 (21 pages).

Australian office action from Australian application No. 2009296195, dated Mar. 28, 2013 (5 pages).

Response with English translation to Chinese Office Action dated Nov. 23, 2012 for Chinese Application No. 200980147643.6, filed Apr. 7, 2013 (36 pages).

European Search Report from EP Application no. 13158245.4 dated Apr. 25, 2013 (38 pages).

Office action from Canadian Application No. 2738658 dated May 27, 2013 (21 pages).

European Communication from European Application No. 13158245.4, dated May 22, 2013 (4 pages).

Chinese Office Action with English translation from corresponding Chinese Application No. 200980147643.6 dated May 17, 2013 (35 pages).

Long, Haim, "Knitting Technology", English translation included, China Textile & Apparel Press, 1st Edition, pp. 12-13, Jun. 2008 (9 pages).

Response to Office Action dated May 27, 2013 in Canadian Application No. 2738658, filed with the Office on Jun. 17, 2013 (20 pages).

(56) References Cited

OTHER PUBLICATIONS

Response to Chinese Office Action with English translation from Chinese Application No. 200980147643.6 dated May 17, 2013, filed Sep. 1, 2013 (7 pages).
Chinese Office Action with English translation from Chinese Application 200980147643.6 dated Dec. 6, 2013 (10 pages).
Chinese Office Action with English translation from Chinese Application 200980147643.6 dated Jul. 28, 2014 (37 pages).
Chinese Office Action from Chinese Application 201110443469.9 dated Dec. 20, 2013 (12 pages).
Chinese response with English translation to Chinese Office Action dated Dec. 20, 2013, filed on Jul. 2, 2014 from Chinese application 201110443469.9 (30 pages).
Chinese Office Action with English translation issued in Chinese Application No. 201110443469.9 dated Oct. 10, 2014 (38 pages).
Chinese Response to Office Action with English translation in Chinese application No. 200980147643.6 filed on Oct. 11, 2014 (39 pages).
Chinese Reasons for Rejection with English Translation issued in Chinese Application No. 200980147643.6 dated Nov. 18, 2014 (42 pages).

FABRIC SYSTEM

CROSS REFERENCE TO RELATED APPLICATION

This application is a continuation application of and claims priority to U.S. Ser. No. 13/272,977, filed on Oct. 13, 2011, which is a continuation application of and claims priority to U.S. Ser. No. 12/569,659, filed on Sep. 29, 2009, which claims benefit under 35 USC § 119(e) of U.S. Provisional Patent Application Ser. No. 61/101,049 filed 29 Sep. 2008, which applications are hereby incorporated fully by reference.

BACKGROUND OF THE INVENTION

1. Field of the Invention

The present invention relates generally to fabric systems, and more specifically to bed coverings constructed of high gauge circular knitted fabrics that accommodate and maintain optimum thermal conditions for sleep, which in turn can lead to faster sleep initiation and deeper, more restorative sleep.

2. Description of Related Art

Sleep problems in the United States are remarkably widespread, affecting roughly three out of four American adults, according to research by the National Sleep Foundation (NSF). Consequently, a great deal of attention has been paid to the circumstances surrounding poor sleep, along with strategies for how to improve it.

The implications are not merely academic. Sleep—not only the right amount of it but also the right quality—impacts not just day-to-day performance, but also "the overall quality of our lives," according to the NSF. Addressing the causes of poor quality sleep, therefore, has ramifications for millions.

Though many factors contribute to sleep quality, the sleep environment itself plays a critical role, and sleep researchers routinely highlight temperature as one of the most important components in creating an environment for optimal sleep. As advised by the University of Maryland Medical Center, "a cool (not cold) bedroom is often the most conducive to sleep." The National Sleep Foundation further notes that "temperatures above 75 degrees Fahrenheit and below 54 degrees will disrupt sleep," with 65 degrees being the ideal sleep temperature for most individuals, according to the NSF.

A lower environmental temperature is not the only thermal factor associated with improved sleep. Researchers have noted a nightly drop in body temperature among healthy, normal adults during sleep. This natural cycle, when inhibited or not functioning properly, can disrupt sleep and delay sleep onset, according to medical researchers at Cornell University. Conversely, the researchers noted, a rapid decline in body temperature not only accelerates sleep onset but also "may facilitate an entry into the deeper stages of sleep."

Therefore, maintaining an appropriately cool sleep environment and accommodating the body's natural tendency to cool itself at night should be a top priority for individuals interested in optimizing their sleep quality. Performance fabrics crafted into bedding applications would be uniquely capable of promoting cool, comfortable—and therefore better—sleep, as these advanced fabrics maximize breathability and heat transfer. Performance fabrics are made for a variety of end-use applications, and can provide multiple functional qualities, such as moisture management, UV protection, anti-microbial, thermo-regulation, and wind/water resistance.

There has been a long felt need in several industries to provide improved bedding to help individuals get better sleep. Such improved bedding would include beneficial wicking among other properties. For example, in marine, boating and recreational vehicle applications, bedding should resist moisture, fit odd-shaped mattresses and beds, and reduce mildew. Particularly with watercraft, there is a need to protect bedding, and specifically sheets, from moisture and mildew accumulation.

An additional problem with bedding, not just with marine and recreational vehicles, is the sticky, wet feeling that can occur when the bedding sheets are wet due to body sweat, environmental moisture, or other bodily fluids. In particular, when bedding is used during hot weather, or is continuously used for a long time by a person suffering from an illness, problems can arise in that the conventional bed sheet of cotton fiber or the like cannot sufficiently absorb the moisture. All of these issues lead to poor sleep.

To date, performance fabric bedding products are not known. There are width limitations in the manufacturing of high gauge circular knit fabrics, because the finished width of bedding fabrics are dictated by the machine used in its construction. At present, performance fabrics are manufactured with a maximum width of under 90 inches wide, given present manufacturing and technical limitations, along with the inability of alternate manufacturing processes to produce a fabric with identical performance attributes. Yet, normal bed sheet panels can be 102 by 91 inches or larger. Thus, performance fabrics cannot yet be used for bed sheets.

Some conventional solutions for the above issues that hinder a good night's sleep include U.S. Pat. No. 4,648,186, which discloses an absorbent wood pulp cellulose fiber that is provided in a variety of sizes and is placed under a mattress. The wood pulp is water absorbent and acts to capture moisture to prevent such moisture from being retained by the bedding or the bedding sheets. However, this proposed solution does not interact with the bedding or the bedding sheets, but merely acts as a sponge for moisture that is in proximity to the target bedding.

U.S. Pat. No. 5,092,088 discloses a sheet-like mat comprised of a mat cover, the inside of which is divided into a plurality of bag-like spaces, and a drying agent packed into a bag and contained in the bag-like spaces in such a manner that the drying agent cannot fall out of the bag-like spaces. A magnesium sulfate, a high polymer absorbent, a silica gel or the like can be used as the drying agent. As can be seen, this proposed solution to moisture in bedding is cumbersome and chemically-based.

In the athletic apparel industry, moisture wicking fabric has been used to construct athletic apparel. For example, U.S. Pat. No. 5,636,380 discloses a base fabric of CoolmaxQ high moisture evaporation fabric having one or more insulating panels of ThermaxB or ThermastatQ hollow core fiber fabric having moisture wicking capability and applied to the inner side of the garment for skin contact at selected areas of the body where muscle protection is desired. However, this application cannot be applied to bedding sheets due to the limitations of the size of the performance fabrics manufactured. Further, performance fabric such as this type cannot be easily stitched together as the denier is so fine that stitching this fabric results in the stitching simply falling apart.

Circular knitting is typically used for athletic apparel. The process includes circularly knitting yarns into fabrics. Circular knitting is a form of weft knitting where the knitting needles are organized into a circular knitting bed. A cylinder rotates and interacts with a cam to move the needles reciprocally for knitting action. The yarns to be knitted are fed from packages to a carrier plate that directs the yarn strands to the needles. The circular fabric emerges from the knitting needles in a tubular form through the center of the cylinder. This process is described in U.S. Pat. No. 7,117,695. However, the machinery presently available for this method of manufacture can only produce a fabric with a maximum width of approximately 90 inches. Therefore, this process has not been known to manufacture sheets, since sheets can have dimensions of 91 inches by 102 inches or greater.

Further, the machinery that is used for bedding is very different than for athletic wear. For example, bedding manufacturing equipment is not equipped to sew flatlock stitching or to provide circular knitting. Bed sheets typically are knit using a process known as warp knitting, a process capable of producing finished fabrics in the widths required for bedding. This method, however, cannot be employed to produce high-quality performance fabrics. Warp knitting is not capable of reproducing these fabrics' fine tactile qualities nor their omni-direction stretch properties, for example.

Circular knitting must be employed to produce a performance fabric that retains these fabric's full range of benefits and advantages. However, in order to produce a fabric of the proper width for bedding applications, a circular knit machine of at least 48 inches in diameter would be necessary. Manufacturing limitations therefore preclude the construction of performance fabrics at proper widths for bedding. The industry is unsure if it could actually knit and then finish performance fabrics at these large sizes, even if the machinery were readily available.

Further, athletic sewing factories are typically not equipped to sew and handle large pieces of fabrics so that equipment limitations do not allow for the manufacture of bedding sheets.

What is needed, therefore, is a bedding system that utilizes performance fabrics and their beneficial properties, the design of which acknowledges and addresses limitations in the manufacture of these fabrics. It is to such a system that the present invention is primarily directed.

BRIEF SUMMARY OF THE INVENTION

Briefly described, in preferred form, the present invention is a high gauge circular knit fabric for use in bedding, and a method for manufacturing such bedding. The bedding fabric has superior performance properties, while allowing for manufacture by machinery presently available and in use. In order to achieve a finished width of the size needed to create sheet-sized performance fabric, a high gauge circular knit machine of at least 48 inches in diameter is necessary. And while warp knitting machines are available that can produce wider fabrics, this method will not provide a fabric with the tactile qualities required, nor provide a fabric with omni-directional stretch.

In an exemplary embodiment, the present invention is a method of making a finished fabric comprising at least two discrete performance fabric portions, and joining at least two discrete performance fabric portions to form the finished fabric. Forming the at least two discrete performance fabric portions can comprise knitting at least two discrete performance fabric portions, and more preferably, circular knitting at least two discrete performance fabric portions. Joining the at least two discrete performance fabric portions to form the finished fabric can comprise stitching at least two discrete performance fabric portions together to form the finished fabric.

The at least two discrete performance fabric portions can have different fabric characteristics. Fabric characteristics as used herein include, among other things, moisture management, UV protection, anti-microbial, thermo-regulation, wind resistance and water resistance.

The finished fabric can be used in, among other applications, residential settings, or in marine, boating and recreational vehicle environments.

The present sheets offer enhanced drape and comfort compared to traditional cotton bedding, and are as fine as silk, yet provide the benefits of high elasticity and recovery along with superior breathability, body-heat transport, and moisture management as compared to traditional cotton bedding.

Conventional fitted sheets can bunch and slide on standard mattress sizes. Furthermore, if the fitted bed sheets do not fit properly, they do not provide a smooth surface to lie on. The present invention overcomes these issues.

The present high gauge circular knit fabrics stretch to fit and offer superior recovery on the mattress allowing the fabric to conform to fit the mattress without popping off the corners of the mattress or billowing. The performance fabric can include spandex, offers a better fit than conventional bedding products, can accommodate larger or smaller mattress sizes with a single size sheet, and can conform to mattresses with various odd dimensions.

Spandex—or elastane—is a synthetic fiber known for its exceptional elasticity. It is stronger and more durable than rubber, its major non-synthetic competitor. It is a polyurethanepolyurea copolymer that was invented by DuPont. "Spandex" is a generic name, and an anagram of the word "expands." "Spandex" is the preferred name in North America; elsewhere it is referred to as "elastane." The most famous brand name associated with spandex is Lycra, a trademark of Invista.

The present high gauge circular knit fabric offers durability in reduced pilling and pulling when compared to other knit technologies, and offer reduced wrinkles and enhanced color steadfastness In a preferred embodiment, the present performance fabric can allow for a one-size fitted sheet that can actually fit two different size mattresses. For example, the full fitted sheet of the present invention can fit on both the full and queen size bed. The twin fitted sheet of the present invention will also fit an XL twin. In a boating application, the present invention can be produced to fit almost every custom boat mattress.

Testing of the present invention conducted at the North Carolina State University (NCSU) Center for Research on Textile Protection and Comfort confirms that the present performance fabrics provide a cooler sleeping environment than cotton. Performance bedding was tested side-by-side with commercially available cotton bed sheets in a series of procedures designed to measure each product's heat- and moisture-transport properties, as well as warm/cool-to-touch thermal transport capabilities.

Across all tests, the present performance fabrics in bedding outperformed cotton, demonstrating the performance fabric's superiority in establishing and maintaining thermal comfort during sleep. This advantage is evident to users from the very onset, as NCSU testing indicates that, on average, performance bedding of the present invention offers improved heat transfer upon initial contact with the skin, resulting in a cooler-to-the-touch feeling.

During sleep, high gauge circular knit performance bedding of the present invention helps to maintain thermal comfort by trapping less body heat and breathing better than cotton. Testing has demonstrated that performance bedding made out of performance fabrics transfers heat away from the body up to two times more effectively than cotton. This is critically important not only for sustained comfort during sleep, but also in terms of enabling the body to cool itself as rapidly as possible to facilitate sleep onset. In addition to trapping less heat, performance bedding breathes better than cotton—up to 50% better, giving performance bedding a strong advantage in terms of ventilation and heat and moisture transfer.

The performance advantage over cotton holds true for simulated dry and wet skin conditions, confirming that certain performance fabrics in bedding are better suited than cotton at managing moisture (e.g., sweat) to maintain thermal comfort. In addition to wicking moisture away from the skin through capillary action, the performance fabric's advanced breathability further enables heat and moisture transfer through evaporative cooling. As a result, the user is kept cooler, drier and more comfortable than with cotton.

The present performance bedding holds a distinct advantage over cotton in enabling, accommodating and maintaining optimum thermal conditions for sleep, which in turn can lead to faster sleep initiation and deeper, more restorative sleep.

These and other objects, features and advantages of the present invention will become more apparent upon reading the following specification in conjunction with the accompanying drawings.

DETAILED DESCRIPTION OF PREFERRED EMBODIMENTS

Figure 1:
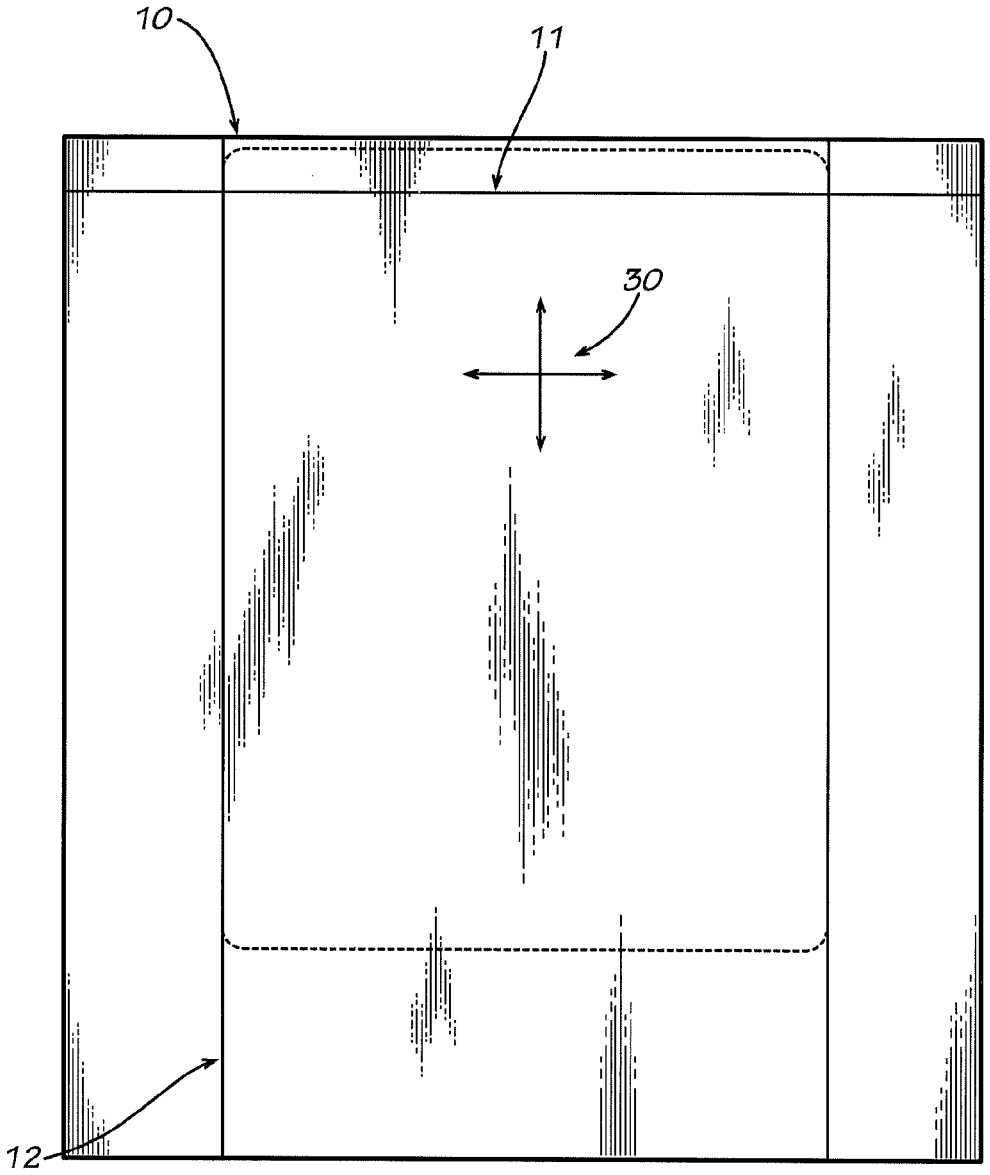
FIG. 1 illustrates a preferred embodiment of the present invention.

Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It must also be noted that, as used in the specification and the appended claims, the singular forms "a," "an" and "the" include plural referents unless the context clearly dictates otherwise. For example, reference to a sheet or portion is intended also to include the manufacturing of a plurality of sheets or portions. References to a sheet containing "a" constituent is intended to include other constituents in addition to the one named.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" one particular value and/or to "about" or "approximately" another particular value. When such a range is expressed, another embodiment includes from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a fabric or system does not preclude the presence of additional components or intervening components between those components expressly identified.

Figure 4:
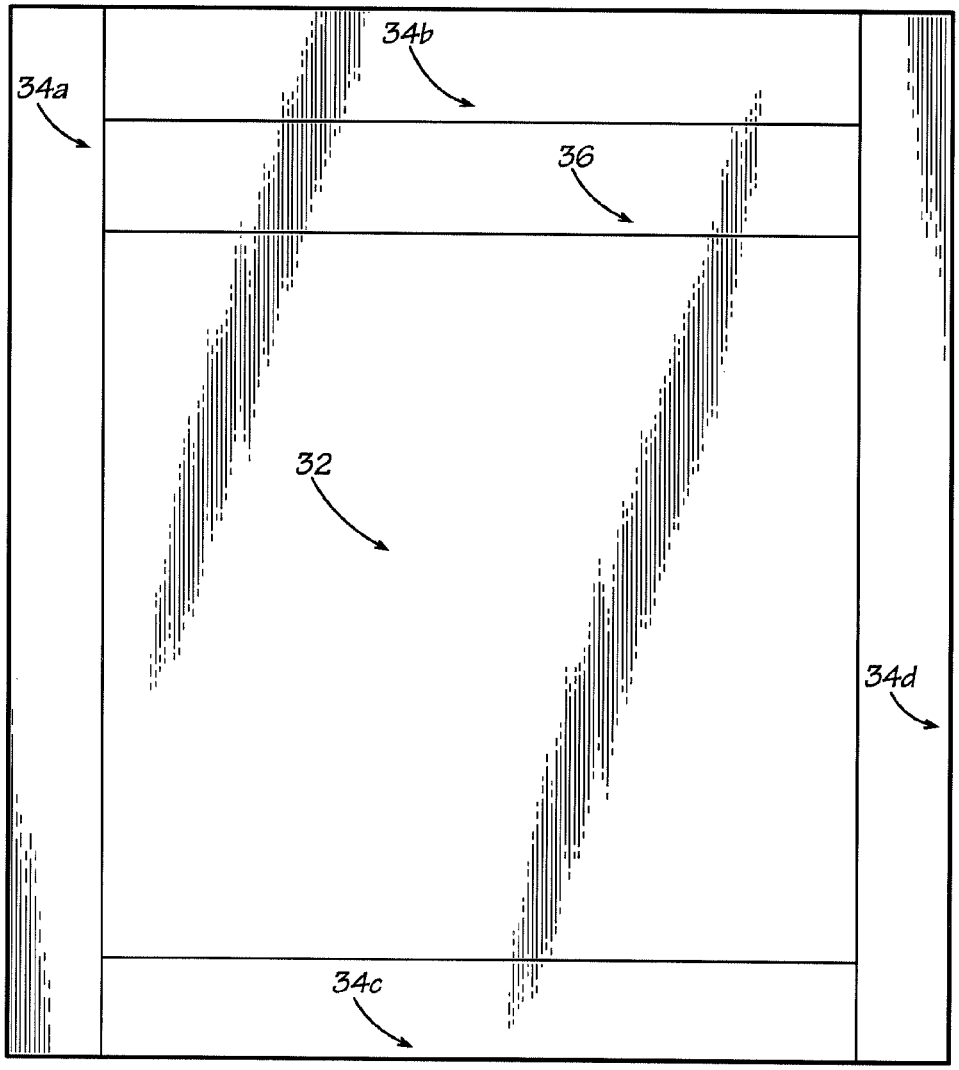
FIG. 4 illustrates another preferred embodiment of the present invention.

Referring now in detail to the drawing figures, wherein like reference numerals represent like parts throughout the several views, the present invention of FIGS. 1 and 4 provides a sheet 10 shown having dimensions of 102 inches in length and 91 inches in width. The material is manufactured from performance fabric, which can include, for example, varying amounts of one or more of Lycra, Coolmax, Thermax and Thermastat. In a preferred embodiment, the fabric is treated so that the fabric has antimicrobial properties. By using circular-knit performance fabric, the fabric is able to provide elasticity in all four directions. This property allows for the sheet to fit extraordinary mattress, cushion and bedding shapes, as well as providing better fits for traditional rectangular sheets. By using performance fabrics, the sheet has elastic properties that allow stretching in the directions shown as 30. In addition, by using circular-knit performance fabric, the resulting bedding retains an exceptionally fine tactile quality critical for providing maximum levels of enhanced comfort.

An alternative to circular knitting is non-circular knitting—for example, warp knitting. This method can achieve widths greater than circular knitting. Industrial warp knit machines, for example, can produce tricote warp knit fabrics up to 130-140 inches in width. Circular knitting, however, is less expensive, as it requires less set-up time. Circular knitting also provides greater multidirectional stretch.

In order to provide a sheet that exceeds the maximum dimensions of fabric that can be produced by available circular knitting machines, flat lock stitching 12 is used to join a plurality of portions resulting in a sheet that is 91 inches wide (as shown). In an exemplary embodiment, piping 11 can be included in close proximity to the stitching. The stitching can be the same color as the fabric of the sheet portions, or different color(s). The piping can be ¾ inch straight piping without a cord or other filler. In one preferred embodiment, the stitching is 16 stitches per inch. Piping 11 can be included at one end of the sheet and can be the same or a different color as the sheet fabric.

For a fitted sheet, the sheet can include an elastic portion surrounding the edge of the fitted sheet to better keep the fitted sheet in place when placed on a mattress or other sleeping surface. A cord can be sewn into the edge of the fitted sheet and cinched around the mattress or other sleeping surface to better hold the fitted sheet in place.

Figure 2:
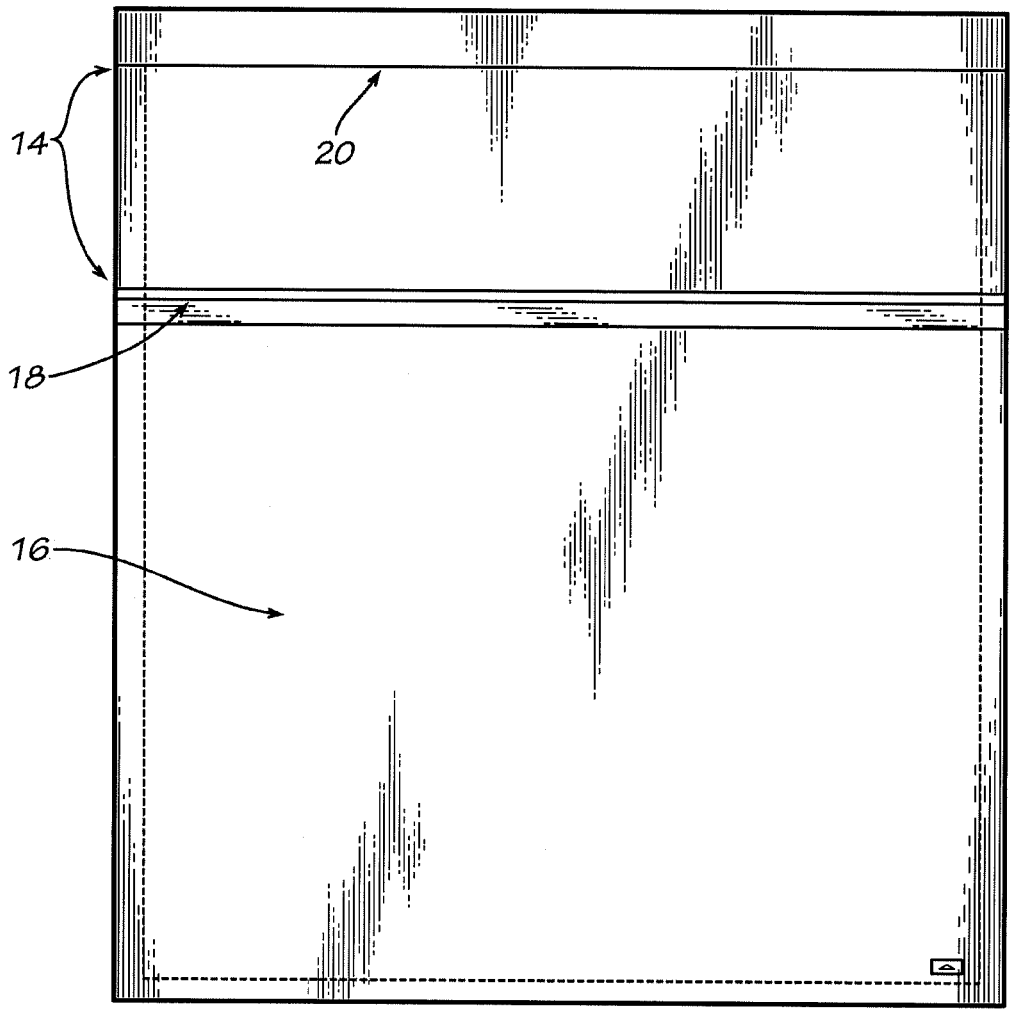
FIG. 2 illustrates another preferred embodiment of the present invention.

Referring to FIG. 2, a sheet is shown having dimensions of 91 inches wide and 102 inches in length. In this embodiment, stitching 14 is shown 34 inches from an interior edge 18 of a main portion 16 and another stitch 14 at edge 20 of the sewn-on portion. Flat lock stitching can be used for the stitching. Piping can be applied at or in proximity to the stitching.

Figure 3A:
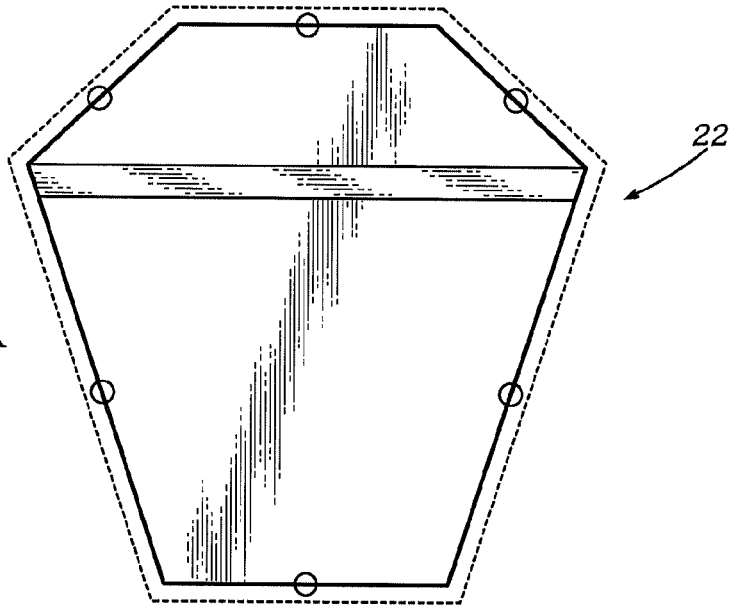
FIG. 3A illustrates a further preferred embodiment of the present invention.
Figure 3B:
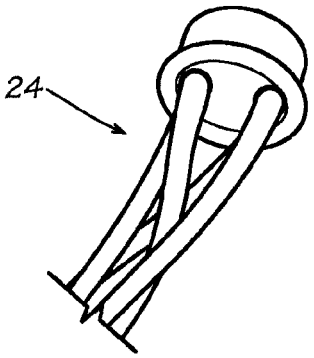
FIG. 3B illustrates pull ties useful with a preferred embodiment of the present invention.
Figure 3C:
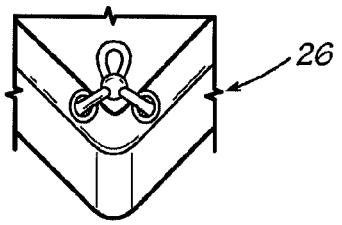
FIG. 3C illustrates a cinched pull tie of FIG. 3B.

Referring to FIGS. 3A-E, a non-rectangular shaped sheet is shown in FIG. 3A. In this exemplary embodiment, elastic can be included around the edge of the fitted sheet to better maintain the fitted sheet in position when placed on a sleeping surface. In one embodiment, pull ties 24 (FIG. 3B) can be installed at various locations around the edge of the fitted sheet in order to assist in maintaining the fitted sheet secured to the sleeping surface. The pull tie can be cinched to increase tension around the edge of the fitted sheet as shown by 26 (FIG. 3C).

Figure 3D:
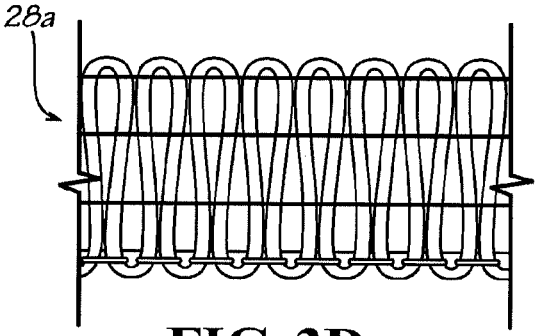
FIG. 3D-3E illustrate stitching embodiments useful for securing portions of the present invention together.
Figure 3E:
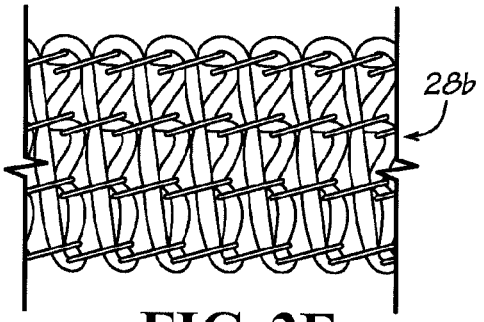

Stitching used for securing the portions of the sheet together can include that shown in FIGS. 3D-3E, for example as 28*a*. In another embodiment, the stitching used for securing the portion of fabric together is shown as 28*b*.

Referring to FIG. 4, yet another preferred embodiment of the invention is shown. In this embodiment, the sheet can be assembled through stitching of differing fabrics for generating performance zones in the sheet. For example, zone 32 can have higher wicking properties than the other zones since this area is where the majority of the individual body rests. Areas 34*a* through 34*d* can have higher spandex or other elastic fabric properties so that the fit around a sleeping surface is improved. Area 36 may have thermal properties such as increased cooling since this area is generally where the individual's head lies. In an exemplary embodiment, the pillow covers of pillows used by the individual also have differing properties from the remainder of the sheet, e.g., thermal properties.

The present invention encompasses the construction of bedding materials that have superior performance properties while allowing for manufacture by machinery presently available and in use. More specifically, the invention is related to a new method for fabricating a covering and or sheets in bedding. When using the circular knitting machine, the high gauge performance fabrics can only be made to a maximum size of 72.5 inches without losing the integrity of the spandex in the fabric. Yet, normal sheet panels are 102×91 inches. This presents problems when manufacturing sheets from performance fabrics.

Additionally, special stitching techniques must be used given the thread density of the fabric. Using this special stitching, panels are sewn together to produce bedding or a sheet that is the proper size for standard bed sheets. Because discrete portions/panels are used in the manufacture of the present fabrics, panels can be selected that provide different properties for different areas of the bedding (FIG. 4). Stitching or seams on the sheet can also allow for the ease of making the bed. Because the bedding is made from performance fabric with spandex, it stretches to permit multiple and custom sizing for applications in cribs, recreational vehicles and boats.

Circular knitting machines used for high gauge performance bedding fabrics are called high-gauge circular knitting machines, because of dense knitting with thin yarn. High gauge generally denotes 17 gauges or more. Seventeen gauges indicate that 17 or more cylinder needles are contained in one inch. Circular knitting machines of less than 17 gauges are referred to as low-gauge circular knitting machines. The low-gauge circular knitting machines are often used to knit outerwear.

"Yarn count" indicates the linear density (yarn diameter or fineness) to which that particular yarn has been spun. The choice of yarn count is restricted by the type of knitting machine employed and the knitting construction. The yarn count, in turn, influences the cost, weight, opacity, hand and drape of the resulting knitted structure. In general, staple spun yarns tend to be comparatively more expensive the finer their count, because finer fibers and a more exacting spinning process are necessary in order to prevent the yarn from showing an irregular appearance.

A top width in the 90-inch range is currently possible using a circular knit fabric formed on a 36-38-inch diameter machine, although higher levels of spandex in the performance fabric tend to pull the width in. In just one example, on a 30-inch diameter machine, the spandex can reduce an otherwise 94-inch circumference fabric tube to one with a 60-65 inch finished width.

A major limitation in finished width is not strictly a knitting concern but also concerns finishing. With performance fabric, it tends to sag in the middle—increasingly so with greater widths—making finishing difficult to impossible above a certain threshold. A possible 90-inch finished width is contingent upon having a good finishing set-up capable of handling the present performance fabric. This potential for difficulties would only become compounded at the larger widths required for bed sheets.

In a preferred process, the present fabric undergoes a heat setting finishing process. Applying a moisture-wicking finish to another fabric—like cotton—that can be produced at larger widths appears unlikely to match the moisture-control properties of the present fabric, as polyester itself is naturally moisture-resistant and there are physical actions (e.g. capillary action) at play. Further, the use of cotton comes at the expense of breathability and heat-transfer capabilities (as confirmed by laboratory testing) and stretchability.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A bed covering at least 90 inches wide comprising a circularly knit fabric area where a majority of an individual body is capable of resting when the bed covering is on a bed, the circularly knit fabric area formed from a fabric knit at 17 gauges or higher with at least one elastic synthetic fiber, such that the fabric has an elasticity which results in a tendency of the fabric to sag that would interfere with a finishing process if the fabric were circularly knit at greater than a 72.5 inch circumference.

2. The bed covering of claim 1 comprising at least two joined discrete portions of fabric.

3. The bed covering of claim 2 comprising one portion of circularly knit fabric and one or more portions of fabric other than circularly knit fabric.

4. The bed covering of claim 1 in which the fabric comprises polyurethanepolyurea copolymer fiber.

5. The bed covering of claim 4 in which the fabric comprises polyurethanepolyurea copolymer fiber in a proportion such that, if the fabric had been circularly knit at a high gauge, the fabric could have been knit at no more than a 72.5 inch circumference without losing integrity of the polyurethanepolyurea copolymer fiber.

6. The bed covering of claim 1 having dimensions of approximately 102 inches in length and approximately 91 inches in width when the bed covering is not stretched.

7. The bed covering of claim 1 in which the circularly knit fabric area has a width of a full size bed.

8. The bed covering of claim 1 in which the circularly knit fabric area has a width of a queen size bed.

9. A bed covering at least 90 inches wide comprising a circularly knit fabric area where the majority of an individual body is capable of resting when the bed covering is on a bed, the circularly knit fabric area comprising a fabric including polyurethanepolyurea copolymer fiber and having been circularly knit at 17 gauges or higher, the fabric comprising the polyurethanepolyurea copolymer fiber in a proportion such that, if circularly knit at a high gauge, the circularly knit fabric area could be knit at no more than a 72.5 inch circumference without losing integrity of the polyurethanepolyurea copolymer fiber.

10. The bed covering of claim 9 in which the bed covering comprises at least two joined discrete portions of the circularly knit fabric.

11. The bed covering of claim 9 comprising one portion of circularly knit fabric and one or more portions of fabric other than circularly knit fabric.

12. The bed covering of claim 9 in which the circularly knit fabric area comprises polyurethanepolyurea copolymer fiber in a proportion such that the circularly knit fabric has higher breathability than a cotton fabric.

13. The bed covering of claim 9 in which the polyurethanepolyurea copolymer fiber is included in the fabric of the circularly knit fabric area in a proportion such that the circularly knit fabric area has higher heat transfer than a cotton fabric.

14. The bed covering of claim 9 in which the fabric of the circularly knit fabric area comprises the polyurethanepolyurea copolymer fiber in a proportion such that the circularly knit fabric area has higher moisture wicking characteristics than a cotton fabric.

15. The bed covering of claim 9 in which the fabric area has a width of a full size bed.

16. The bed covering of claim 9 in which the fabric area has a width of a queen size bed.

17. A bed covering comprising:

a finished fabric having a width of at least 90 inches and comprising:

a first fabric portion where a majority of an individual body is capable of resting when the bed covering is on a bed; and two or more second fabric portions attached to the first fabric portion, wherein:

the first fabric portion forms a majority of the finished fabric;

the first fabric portion and at least two of the second fabric portions in combination extend across the width of the finished fabric; and the first fabric portion is formed from a circularly knit fabric knit at 17 gauges or higher with at least one elastic synthetic fiber, such that the circularly knit fabric has an elasticity which results in a tendency of the fabric to sag that would interfere with a finishing process if the circularly knit fabric were circularly knit at greater than a 72.5 inch circumference.

18. The bed covering of claim 17, wherein the circularly knit fabric comprises polyurethanepolyurea copolymer fiber.

19. The bed covering of claim 17, a proportion of the polyurethanepolyurea copolymer fiber in the circularly knit fabric is such that if the circularly knit fabric had been circularly knit at a high gauge, the circularly knit fabric could have been knit at no more than a 72.5 inch circumference without losing integrity of the polyurethanepolyurea copolymer fiber.

20. The bed covering of claim 17, wherein the first fabric portion has a width of a full size bed.

21. The bed covering of claim 17, wherein the first fabric portion has a width of a queen size bed.

* * * * *